US005623870A

United States Patent [19]

Daniel

[11] Patent Number: 5,623,870

[45] Date of Patent: Apr. 29, 1997

[54] OIL MIST ELIMINATOR FOR A PRESS OIL CONTROL SYSTEM

[75] Inventor: Edward A. Daniel, Fort Loramie, Ohio

[73] Assignee: The Minster Machine Company, Minster, Ohio

[21] Appl. No.: 530,826

[22] Filed: Sep. 20, 1995

Related U.S. Application Data

[63] Continuation of Ser. No. 305,184, Sep. 13, 1994, abandoned, which is a continuation-in-part of Ser. No. 108,067, Aug. 17, 1993, abandoned.

[51] Int. Cl.[6] ..... B30B 15/00

[52] U.S. Cl. ..... 100/102; 60/455; 92/86; 100/282; 100/299; 184/6.14; 184/6.23; 277/20

[58] Field of Search ..... 100/102, 214, 100/280, 282, 299; 60/455; 92/86; 184/6.14, 6.21, 6.23, 6.24; 277/3, 19, 20, 72 R

[56] References Cited

U.S. PATENT DOCUMENTS

| | | | |
|---|---|---|---|
| 2,000,265 | 5/1935 | Vickers | 92/86 |
| 2,319,232 | 5/1943 | Holmes et al. | 100/280 |
| 2,349,597 | 5/1944 | Nenninger et al. | 184/6.14 |
| 2,366,824 | 1/1945 | Zimmermann . | |
| 2,369,249 | 2/1945 | Rainalter | 277/16 |
| 2,446,862 | 8/1948 | Wilders et al. | 277/20 |
| 2,457,893 | 1/1949 | Hlinsky | 184/6.14 |
| 3,030,879 | 4/1962 | Lasko | 100/214 |
| 3,059,937 | 10/1962 | Wettstein | 277/110 |
| 3,869,963 | 3/1975 | Schindel | 92/86 |
| 3,877,547 | 4/1975 | Willuweit et al. | 184/6.23 |
| 4,014,555 | 3/1977 | Jacottet | 277/3 |
| 4,245,844 | 1/1981 | Pohl et al. | 277/3 |
| 4,425,838 | 1/1984 | Pippert | 92/86 |
| 4,499,969 | 2/1985 | Toombs | 184/106 |
| 4,854,152 | 8/1989 | Portmann | 100/214 |
| 4,896,890 | 1/1990 | Mauney | 277/3 |
| 4,945,724 | 8/1990 | O'Neal | 277/72 R |
| 5,061,078 | 10/1991 | Yada | 92/86 |
| 5,072,949 | 12/1991 | Lopperi | 277/3 |
| 5,209,098 | 5/1993 | Cudzik | 184/6.21 |
| 5,259,225 | 11/1993 | Koch | 72/43 |

FOREIGN PATENT DOCUMENTS

| | | | |
|---|---|---|---|
| 0326980 | 8/1989 | European Pat. Off. . | |
| 0334655 | 9/1989 | European Pat. Off. . | |
| 3341104 | 5/1985 | Germany . | |
| 3502538 | 8/1985 | Germany | 92/86 |
| 4109685 | 9/1992 | Germany . | |
| 4128615 | 1/1993 | Germany . | |
| 1068197 | 5/1967 | United Kingdom . | |

*Primary Examiner*—Stephen F. Gerrity
*Attorney, Agent, or Firm*—Randall J. Knuth

[57] ABSTRACT

An oil mist eliminator filter used with a dynamic oil control mechanism consisting of a vacuum-inducing jet-pump to vacuum oil leaking from about an oil seal, an oil seal located around the drive piston on the press slide, a drain port located about the housing in which the drive piston reciprocates. The oil mist eliminator filter, downstream of the jet pump, separates the oil from the air with 99.97% efficiency allowing the cleaned air to escape freely to atmosphere without causing pressurization of the press reservoir and leaks at the press reservoir, and allowing the oil to constantly recirculate back to the press reservoir thus permitting use of the oil control system without the need to shut the oil control system off to drain accumulated leakage oil.

11 Claims, 4 Drawing Sheets

OIL MIST ELIMINATOR FOR A PRESS OIL CONTROL SYSTEM

CROSS REFERENCE TO RELATED APPLICATIONS

This is a continuation of application Ser. No. 08/305,184, filed Sep. 13, 1994 (abandoned), which is a continuation-in-part of application Ser. No. 8/108,067, filed Aug. 17, 1993 (abandoned).

BACKGROUND OF THE INVENTION

The present invention relates generally to mechanical presses or to any press with a sealed drive piston, and in particular, to an oil mist eliminator in an oil control system which prevents lubricating oil from leaking onto and contaminating the product stamped by the press die.

Mechanical presses, for example, straight side and gap frame stamping and drawing presses, comprise a frame having a crown and bed and a slide supported within the frame for motion toward and away from the bed. Between the slide and bed is located the press die within which a product is stamped or drawn. The slide is driven by a crankshaft having a connecting arm connected to the slide. Such mechanical presses are widely used for stamping and drawing operations and vary substantially in size and available tonnage depending upon the intended use.

In most cases, lubricating oil within the press drive, through gravity and open areas in the press crown, moves down onto the slide and ultimately migrates toward the press die. This oil can find its way to the product being worked upon in the press. If the workpiece becomes contaminated with oil, it may be rejected and scrapped, thereby increasing production costs. This is an important issue in industries dealing with food and beverage containers.

Certain prior art presses have been designed with pistons which protrude from the bottom of the crown. The slide is attached to these pistons which are in turn connected to the press drive for reciprocation. Seals installed about these pistons seal the oil within the crown and keep it from contaminating the workpieces. This oil control means is passive, and works only while the seal maintains its integrity. Seal damage due to installation, contamination, corrosion, or seal compression either occur rapidly or eventually, degrading the seals' ability to retain oil within the crown. Eventually, an oil leak occurs that allows oil to reach the stamped workpieces, thus ruining the product and increasing production costs.

Other prior art oil control systems utilize a filter upstream of the pump suction port. A disadvantage of this arrangement is that since the filter is on the vacuum side of the pump, the filter cannot be drained while the pump is in operation. The oil control system must be shut off to discharge the pump because ambient air simply runs up the filter drain, if any, and prevents the oil from draining out of the filter.

SUMMARY OF THE INVENTION

The present invention overcomes the disadvantages inherent in prior art oil control systems by providing an oil mist eliminator filter downstream of the jet pump exhaust flow.

The oil control system used for a machine press provides a seal about the drive piston of the slide to prevent migration of lubrication oil from the press crown to the slide or to the product worked on by the press. The oil control system operates to vacuum oil, that has leaked past the drive piston seal, away from the drive piston to an oil sump or reservoir.

In one form of the oil control system, a vacuum housing having an annular drain port is attached below the oil seal. This drain port is placed under vacuum to pull any oil leaking from the seal, and a certain amount of ambient air, away from the drive piston. A vacuum generator, comprising an air driven ejector or jet pump, creates the oil displacing vacuum within the drain port. By varying the input air to the ejector, the amount of vacuum created in the drain port is controlled.

An oil mist eliminator filter is used to control vapor emissions from the ejector. The oil mist eliminator filters have not been marketed to press manufacturers. An oil mist eliminator filter operates on the same principle as a high line pressure coalescing filter commonly utilized on fluid power devices but the oil mist eliminator filter operates at a much lower back pressure, normally less than 2 psi. A typical high line pressure coalescing filter will not allow an oil control system to function due to the high input pressure required at the coalescing filter and the low output pressure of the jet pump.

The oil mist eliminator filter includes a drain port which allows coalesced oil to return to the press sump. The oil mist eliminator filter element separates the oil from the air exhaust allowing the air to escape directly to the ambient atmosphere.

An advantage of the oil mist eliminator of the present invention is that the unit is downstream of the jet pump so that the press reservoir is not required to be pressurized thus eliminating a cause of oil leaks at the reservoir. The oil mist eliminator filter operates under a slight positive pressure (from the jet pump exhaust) which promotes filtration and drainage from the filter.

A further advantage of the oil mist eliminator of the present invention is that the oil is constantly coalesced and drained off while the oil control system is in operation thus eliminating the need to stop or shut off the oil control system in order to drain the filter. The oil is reclaimed and routed to the press oil reservoir eliminating the need to replace lost oil.

A still further advantage of the oil mist eliminator of the present invention is that up to 99.97% of the oil particles of 0.3 microns and larger are extracted from the oil laden jet pump exhaust by the oil mist eliminator filter thus eliminating leaks and drips from oil laden air collecting at the press reservoir vents or the oil mist eliminator filter exhaust port.

Another advantage of the oil control system of the present invention is that control of leaked oil is accomplished as long as there is a supply of air. Control and capture of oil no longer depends on the total integrity of the seal.

Yet another advantage of the oil control system of the present invention is that removal of oil from the piston is performed after the seal has used it. The oil removal function of the present invention does not increase the friction and heat on the piston, thereby assuring stable parallelism of the slide to the bolster.

Another advantage of the oil control system of the present invention is that control of leaked oil does not depend on the design of the seal. Various seals and geometries of presses may be utilized with the invention.

A further advantage of the oil control system of the present invention is that the amount of air flow transporting the leaked oil can be adjusted depending on the oil leakage rate.

Yet another advantage of the oil control system of the present invention is that oil or cleaning fluid can be evacuated from the seal area to clean the seal housing before service personnel open the press for repair.

The invention, in one form thereof, provides a press having a frame structure with a crown and a bed. A slide, having a drive piston, is guided by the frame structure for reciprocating movement in opposed relationship to the press bed. A drive mechanism is attached to the frame structure to reciprocate the slide. Oil is used to lubricate the moving parts and may collect into an oil sump. A seal is located about the drive piston to prevent oil from a portion above the slide, such as the drive piston, from migrating to the slide or workpiece. An oil control mechanism is arranged about the seal, the mechanism having a vacuum induced air flow to vacuum oil leaking from the seal away from the drive piston, the oil entrained within the air flow. The oil laden air flow passes through an oil mist filter to coalesce the entrained oil to substantially eliminate oil from the air flow.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
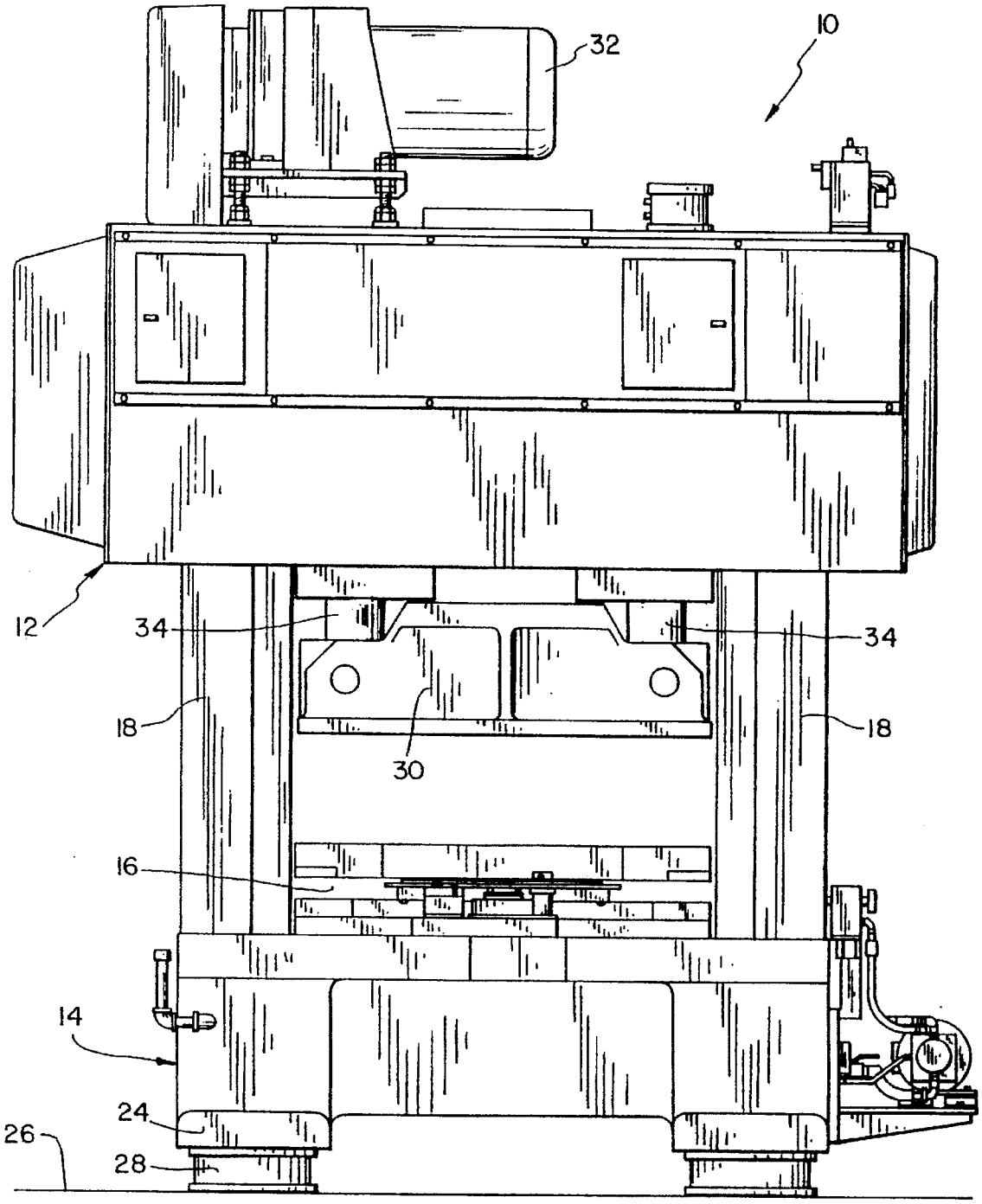
FIG. 1 is a front elevational view of a mechanical press incorporating the vacuum-induced oil control device of the present invention.

Referring now to FIG. 1, mechanical press 10 comprises a crown portion 12, a bed portion 14 having a bolster assembly 16 connected thereto and uprights 18 connecting crown portion 12 with bed portion 14. Uprights 18 are connected to or integral with the underside of crown 12 and the upper side of bed 14. Tie rods (not shown) extend through crown 12, uprights 18 and bed portion 14 and are attached at each end with tie rod nuts. Leg members 24 are formed as an extension of bed 14 and are generally mounted on the shop floor 26 by means of shock absorbing pads 28.

A slide 30 is disposed between press uprights 18 as shown in FIG. 1. Slide 30 reciprocates within press 10 by the action of main drive motor 32 attached to the top portion of crown 12. Connected to main drive motor 32 by means of a belt (not shown) is a hydraulic combination clutch/brake (not shown) as known in the art for controlling the applied torque from motor 32 to slide 30. The hydraulic combination clutch/brake is attached to slide 30 by means of a crankshaft 38 connected to a connecting rod 36 attached to drive piston 34.

The word "piston" utilized in this application identifies generally any member that slides or reciprocates within another. Specifically, the term "drive piston" relates to the portions of slide 30 that are parallel with slide movement and attached to connecting rod 36.

Figure 2:
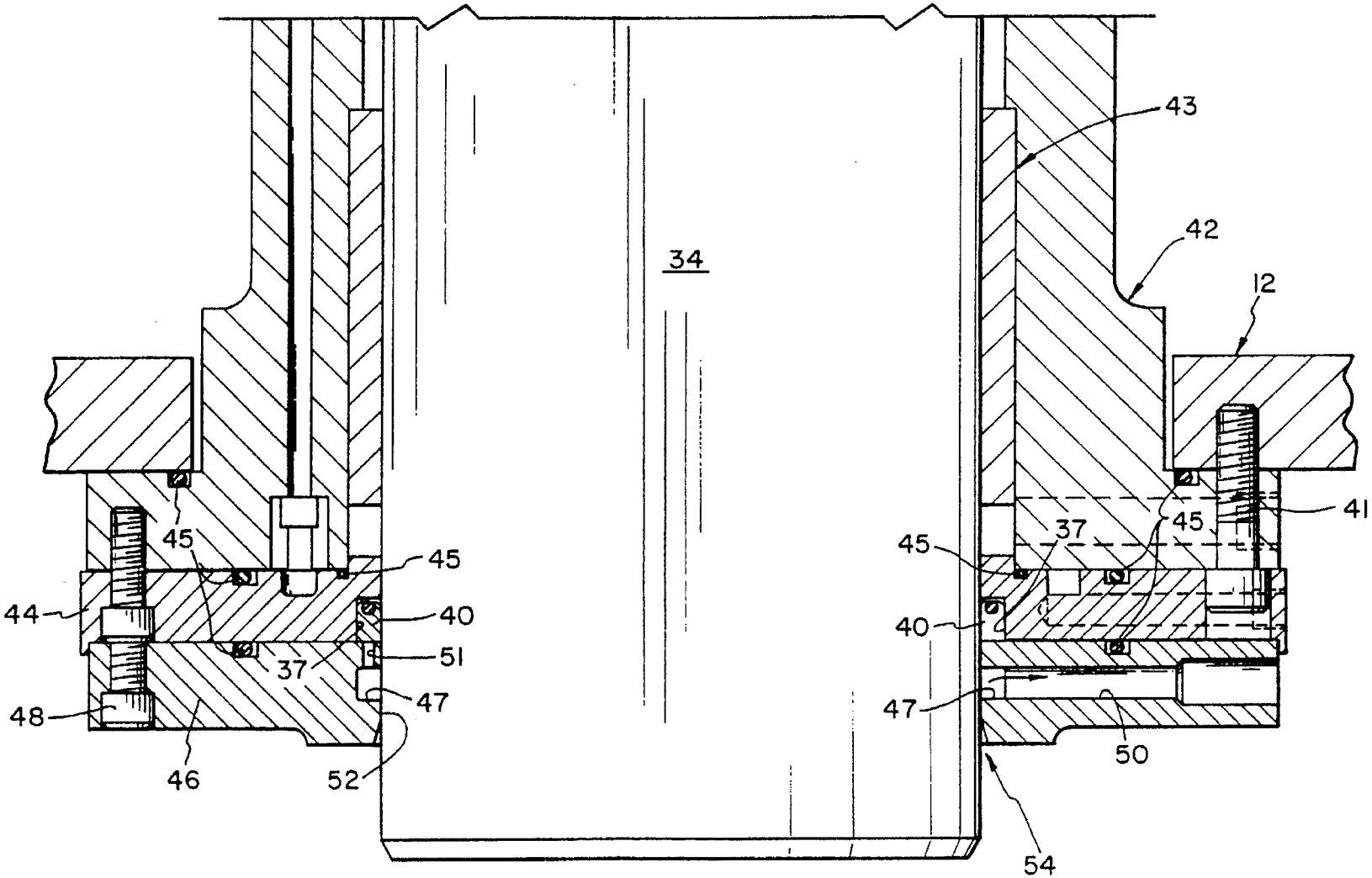
FIG. 2 is a sectional view of the oil seal and drain housing of the mechanical press.

In the prior art, a seal member has been utilized to seal about the drive piston to retain or divert low pressurized lubricating oil possibly flowing from the press crown. As shown in FIG. 2, drive piston 34 is disposed for reciprocation within piston housing 42. Piston housing 42 is normally attached to crown 12. Located between piston housing 42 and drive piston 34 is a guide bushing 43 to maintain adequate clearance between drive piston 34 and piston housing 42, with a seal 40 sealing between drive piston 34 and a piston seal housing 44. Seal 40 is seated in a seal groove 37. A plurality of secondary seals 45 are interfit between metal-to-metal interfaces of press 10 as shown in FIG. 2.

The present invention, in one form thereof, comprises an oil control system 39 generating a vacuum about drive piston 34 near seal 40 to capture any oil that passes past seal 40. As shown in FIG. 2, an additional piston vacuum housing 46 is attached to piston seal housing 44 by screws 48. An annular drain port 47 is located in bore 52 of piston vacuum housing 46 about drive piston 34. It is this drain port 47 that initially catches leaking oil by virtue of a vacuum created therein.

Located within piston vacuum housing 46 is a conduit 50 that attaches between drain port 47 and the vacuum producing mechanism to be described below. As shown in FIG. 2, bore 52 through which drive piston 42 reciprocates, may include a chamfer 54 to ensure an adequate flow of ambient air is available so oil, leaking past seal 40, will be more easily vacuumed into conduit 50 and the rest of the system.

Bore 52, between drain port 47 and the bottom edge of piston vacuum housing 46 or chamfer 54, is particularly sized to create the correct conditions for vacuuming leaking oil away from seal 40 and drive piston 34. At this location, bore 52 has approximately an 0.008" to 0.012" diametral clearance about drive piston 34. The preferred diametral clearance of approximately 0.010" has been found to create the most uniform vacuum induced air flow around piston 34 and upward toward drain port 47. The oil control system, as designed, operates effectively at one (1) inch or more of mercury vacuum level.

Between seal groove 37 and drain port 47 is a plurality of vent ports 51 permitting fluid communication therebetween. Vent port 51 operates to help seal 40 seat in seal groove 37 by allowing air trapped in groove 37 to escape. The vacuum created in drain port 47 also reduces the pressure within groove 37, thereby pulling the heel of seal 40 closer to the bottom of groove 37. Oil may also be pulled through vent port 51 to improve seal stability and seating. During a seal leak, leaking oil will be vacuumed into drain port 47.

Figure 4:
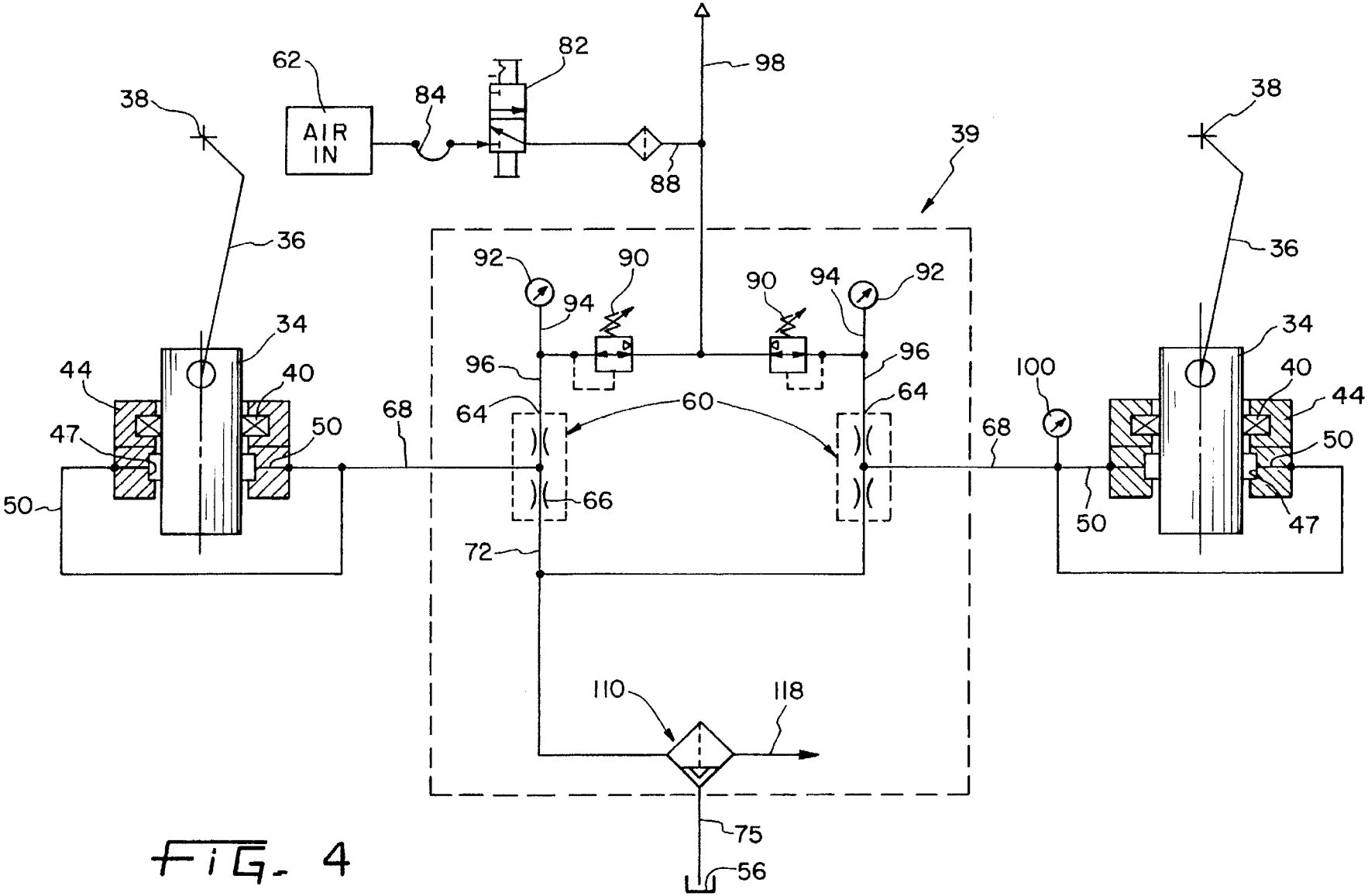
FIG. 4 is a pneumatic and vacuum schematic of one form of the system.

Oil and air vacuumed into conduit 50 proceeds to the vacuum generator 60 and press oil reservoir 56 as shown in FIG. 4. The vacuum-induced air flowing through conduit 50 can be generated by any device as is known in the art, but in the particular embodiment shown in FIG. 4, it has been found to be most reliably and efficiently generated by a device known as an ejector or jet pump 60.

Ejector 60 utilizes compressed air, from a source 62 (FIG. 4), flowing through a compressed air inlet 64 into a passageway 66, having the general configuration and shape of a nozzle, to create a venturi effect. Ejector 60 further includes an inlet 68 that connects to a conduit 50 associated with a particular drive piston 34. Preferably, two conduits 50 are connected to each drain port 47.

Compressed air at a low pressure of approximately 1 to 60 pounds per square inch is introduced through inlet 64 of ejector 60. The venturi design of ejector 60 creates a vacuum pressure area within side inlet 68. This vacuum draws air and oil from drain port 47 through conduit 50 and into ejector 60. The combined flow of oil and air (an oil aerosol), from air inlet 68 exits ejector 60 through exit tube 72 at a pressure lower than at inlet 68, but higher than atmospheric pressure. As shown in FIG. 4 two ejectors 60 empty into a common exit tube 72.

Air and oil, exiting exit tube 72 flow into the bottom of an oil mist eliminator filter 110 of the present invention. Filter 110 comprises a housing 112 in which is disposed an annular filter element 114 to separate the oil from the air. An oil reservoir 56 is connected to filter drain tube 116 by an oil conduit 75 (FIG. 4) to drain collected oil from filter 110. After the oil has been substantially removed from the oil aerosol by the oil mist eliminator filter element 114, the remaining air is expelled as exhaust air out of an air outlet port 118.

Figure 3:
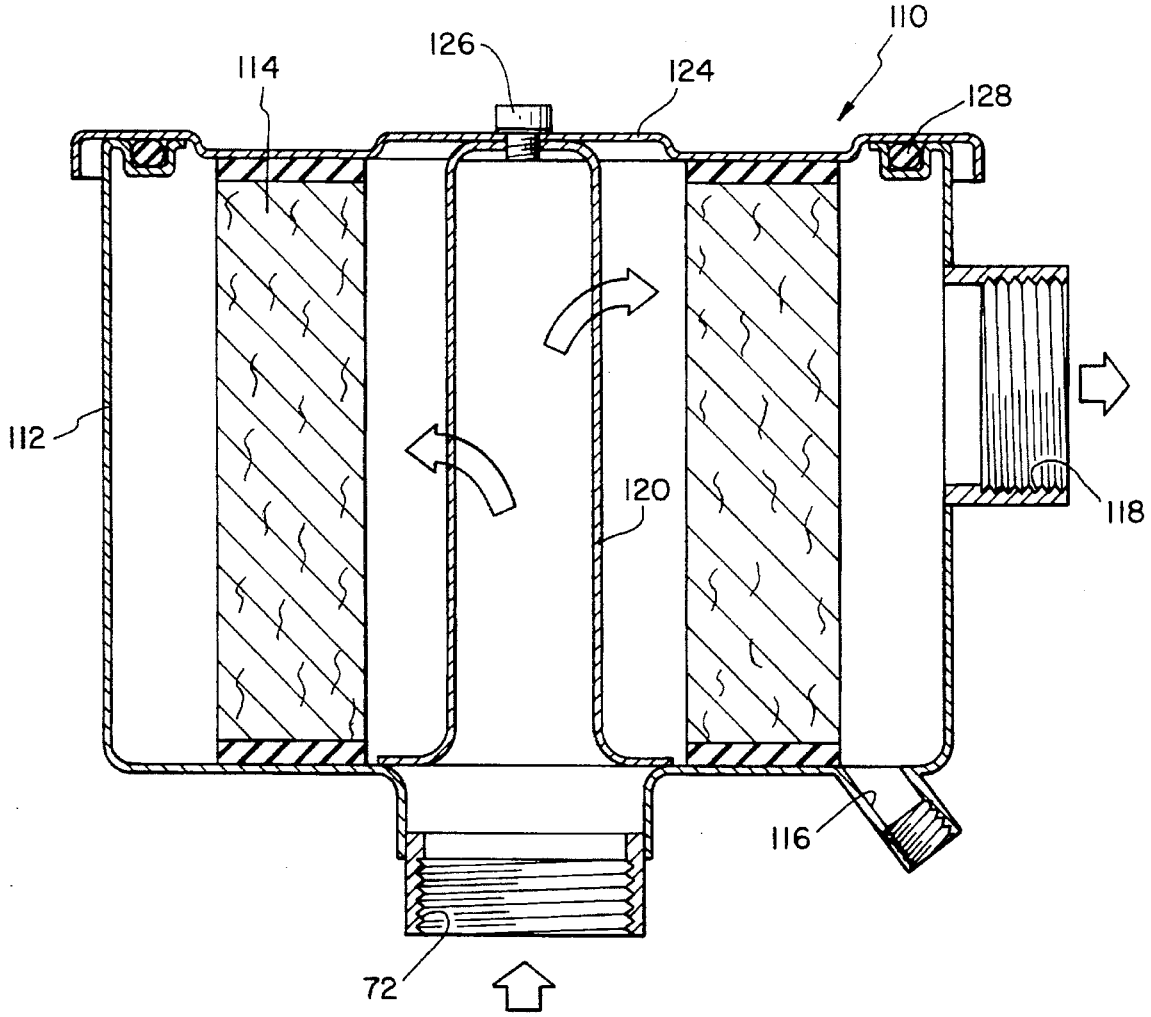
FIG. 3 is a sectional view of the oil mist eliminator filter.

As more clearly shown in FIG. 3, oil mist eliminator filter 110 includes an annular oil filter element 114 disposed within housing 112. Housing 112 includes a centrally located support bracket 120 which is constructed so as to allow passage of the oil aerosol. A removable circular lid 124 is attached by means of a wingnut 126 to support bracket 120 to contain filter element 114 within housing 112. An O ring 128 is disposed between the lid 124 and housing 112 to form a seal there between. Filter element 114 may be constructed from fiberglass or activated charcoal pads to filter the air/oil exhaust. The oil mist eliminator filter 110 is commercially available from Solberg Manufacturing, Inc. of Itasca, Ill. having a Serial No. PCSL-FG848-150HC with a replaceable filter element FG848. When lid 124 is open via unscrewing wingnut 126 insignificant amounts of oil will be lost out of 112 since the entire amount of oil within housing 112 drains away through drain tube 116 as soon as it is collected. The preferred oil mist eliminator filter 110 further enables use of a low back pressure pump such as jet injector 60.

FIG. 4 shows a schematic diagram of the present system utilized by two drive pistons 34. To most reliably and efficiently operate this invention, one ejector 60 vacuum generating device must be connected to each drive piston 34 of press 10 to ensure that oil is drawn off when an oil leak occurs. By utilizing one ejector 60 per drive piston 34, the system can be constructed so that air flow will not be diverted to a point of less resistance, such as a drain housing, if a seal 40 does not leak. This maintains the correct flow of air within the system.

By drawing off oil at several points on drain port 47, an oil leak is kept under control for all rates of possible leakage.

The air flow from source 62 utilized by vacuum ejector 60 is preferably kept on at all times, even while the press 10 is not running, so as to constantly evacuate any lubricating oil leaking from about seal 40.

As shown in the schematic drawing of FIG. 4, compressed air source 62 is attached to a valve 82 to shut off the air flow from source 62 entering oil control system 39. From valve 82, an air hose 84 connects to an air filter 86 and from there another air hose 88 is connected to pressure regulators 90 (FIG. 4). Pressure regulator 90 is of a known type, to permit the operator to vary the air pressure through the oil control system. The press operator is allowed to monitor the compressed air pressure by an optional air pressure gauge 92 connected in line with pressure regulator 90 by means of an air hose 94. Through air hose 94, compressed air flows to air hose 96 and on into air inlet 64 of ejector 60.

As shown in FIG. 4, air hose 88 may attach to a branch portion 98 that can communicate compressed air to other ejectors 60.

In operation, the oil control system 39, in one form thereof, operates as follows. During press 10 operation, power from motor 32 will be conducted to crankshaft 38 shown schematically in FIG. 4. Rotation of crankshaft 38 will cause connecting rod 36 to change rotational motion of crankshaft 38 to rectilinear reciprocating motion of drive piston 34. Seal 40 seals between reciprocating drive piston 34 and housings 44 and 46.

Any oil escaping down past seal 40 along drive piston 34 will be caught in annular drain port 47 connected to conduit 50. Compressed air from air source 62, passing through valve 82, filter 86 and regulator 90, will be injected into ejector 60. Through a venturi effect created in ejector 60, a low pressure area will be developed in conduit 50 connected to ejector 60 through air inlets 68. A combination of air and oil drawn through conduit 50 is now caused to flow through exit tube 72.

The oil, entrained within the air in exit tube 72, will drop out upon contact with the filter element 114. The air, now substantially free from entrained oil, is allowed to pass through air exhaust tube 118, back to the ambient atmosphere.

As shown in FIG. 4, an optional vacuum gauge 100 may be placed in communication with conduit 50 to measure the vacuum developed by ejector 60.

The amount of air flow transporting the oil can be adjusted for various leakage rates of seals 40 by opening and closing regulator 90. Further, oil control is accomplished as long as there is a supply of compressed air. Oil control of the present invention does not depend on 100% integrity of the seal or the intervention of the press operator.

Further due to particular products operated on by press 10, it may be necessary to install air filters within chamfer 54 or within conduits 50 to prevent contamination from the die or slide 30 to be drawn into press oil reservoir 56.

The present invention, as shown in the previous embodiment, is not limited to oil control mechanisms located within the crown of a press. Depending upon the size of press 10, the required tonnage and different operating mechanisms, different locations for oil control system 39 are possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press comprising:

a frame structure with a crown and a bed;

a slide guided by the frame structure for reciprocating movement in opposed relation to said bed;

a drive mechanism attached to said frame structure for reciprocating said slide, said mechanism including a drive piston connected to said slide;

a seal about said drive piston to prevent oil migration from said drive piston to said slide;

an oil control mechanism arranged about said seal, said mechanism having a vacuum induced air flow to vacuum oil leaking from said seal away from said drive piston, the oil thereby entrained within said air flow; and an oil mist filter through which said air flow passes, said oil mist filter coalescing said entrained oil thereby substantially eliminating oil from said air flow.

2. The press of claim 1 in which said oil control mechanism includes an annular drain port under vacuum pressure about said drive piston to capture leaking oil and an air driven ejector connected to said drain port, said ejector creating vacuum pressure within said drain port whereby leaking oil is vacuumed away from said leaking seal through said drain port into said ejector.

3. The press of claim 1 in which said oil mist filter operates at substantially low back pressure.

4. The press of claim 1 in which said oil mist filter includes an oil drain tube to drain coalesced oil out of said oil mist filter during operation whereby said oil control system is not required to be de-energized to empty oil from said oil mist filter.

5. The press of claim 1 in which said oil control mechanism includes an annular drain port under vacuum pressure about said drive piston to capture leaking oil and an air driven ejector connected to said drain port, said ejector creating vacuum pressure within said drain port whereby leaking oil is vacuumed away from said leaking seal through said drain port into said ejector and downstream to said oil mist filter.

6. The press of claim 5 in which said oil mist filter operates at substantially low back pressure.

7. The press of claim 5 in which said oil mist filter operates at less than 2 PSI back pressure.

8. The press of claim 5 in which said oil mist filter includes an oil drain tube connected to said press reservoir to drain coalesced oil out of said oil mist filter and back to said press reservoir whereby said oil control system does not shutdown to empty oil from said oil mist filter.

9. A press comprising:

a frame structure with a crown and a bed;

a slide guided by the frame structure for reciprocating movement in opposed relation to said bed, said slide including a drive piston;

a drive mechanism attached to said frame structure for reciprocating said slide;

a press reservoir connected to said frame structure for containing lubrication oil to lubricate said drive piston;

a seal about said drive piston to prevent oil migration from said drive piston to said slide;

an oil control mechanism arranged about said seal, said mechanism having a vacuum induced air flow to vacuum oil leaking from said seal away from said drive piston, the oil thereby entrained within said air flow, said oil control mechanism includes an annular drain port under vacuum pressure about said drive piston to capture leaking oil and an air driven ejector connected to said drain port, said ejector creating vacuum pressure within said drain port whereby leaking oil is vacuumed away from said leaking seal through said drain port into said ejector and to said oil mist filter; and an oil mist filter through which said air flow passes, said oil mist filter coalescing said entrained oil at low back pressure thereby substantially eliminating oil from said air flow, said oil mist filter including an oil drain tube connected to said press reservoir to drain coalesced oil out of said oil mist filter and back to said press reservoir whereby low pressures within said oil mist filter prevent said press reservoir from becoming pressurized thereby reducing the likelihood of oil leaks.

10. The press of claim 9 in which said oil mist filter operates at less than 2 PSI back pressure.

11. The press of claim 9 in which said oil mist filter includes an oil drain tube connected to said press reservoir to drain coalesced oil out of said oil mist filter and back to said press reservoir whereby said oil control system does not shutdown to empty oil from said oil mist filter.

* * * * *